US006445132B1

(12) United States Patent
Ford

(10) Patent No.: US 6,445,132 B1
(45) Date of Patent: Sep. 3, 2002

(54) MULTI-MODE LIGHT-EMITTING DEVICE FOR UNDERWATER APPLICATIONS

(76) Inventor: Timothy D. F. Ford, 7 Redfern Place, Beaconsfield, Quebec (CA), H9W 4M7

( * ) Notice: Subject to any disclaimer, the term of this patent is extended or adjusted under 35 U.S.C. 154(b) by 0 days.

(21) Appl. No.: 09/795,918

(22) Filed: Feb. 28, 2001

(51) Int. Cl.[7] ..... H05B 37/00

(52) U.S. Cl. ..... 315/56; 315/136; 362/186; 362/205

(58) Field of Search ..... 362/186, 204, 362/205; 315/56, 76, 136

(56) References Cited

U.S. PATENT DOCUMENTS 1,487,983 A * 3/1924 Stiriss ..... 362/206
4,161,018 A * 7/1979 Briggs et al. ..... 362/104
4,296,459 A * 10/1981 DeLuca ..... 362/104
4,531,178 A * 7/1985 Uke ..... 362/158
4,581,686 A * 4/1986 Nelson ..... 362/204
4,613,847 A * 9/1986 Scolari et al. ..... 340/114 R
4,812,953 A * 3/1989 Ask et al. ..... 362/103
5,303,485 A * 4/1994 Goldston ..... 36/137
5,842,777 A * 12/1998 McDermott ..... 362/205

* cited by examiner

*Primary Examiner*—David Vu
(74) *Attorney, Agent, or Firm*—Lorusso & Loud

(57) ABSTRACT

A multi-mode light-emitting device having a light source which changes illumination from steady state to flashing dependent on the polarity of the power source connected to its inputs. A multi-mode switch mechanism which changes from manually activated to water dependent on the polarity of the power source attached to the inputs and a rotating switch mechanism are also part of the invention.

22 Claims, 6 Drawing Sheets

MULTI-MODE LIGHT-EMITTING DEVICE FOR UNDERWATER APPLICATIONS

BACKGROUND OF THE INVENTION

1. Field of the Invention:

The present invention relates, in particular but not exclusively, to a multi-mode light-emitting device for underwater applications.

2. Brief Description of the Prior Art:

Related devices have been proposed in the following prior art documents:

| | | |
|---|---|---|
| U.S. Pat. No. 5,842,777 | McDermott | 12/1/98 |
| U.S. Pat. No. 5,303,485 | Goldston et al. | 4/19/94 |
| U.S. Pat. No. 4,812,953 | Ask et al. | 3/14/89 |
| U.S. Pat. No. 4,613,847 | Scolari et al. | 9/23/86 |
| JP 62071287 | Masaru | 9/25/85 |
| U.S. Pat. No. 4,581,686 | Nelson | 4/8/86 |
| U.S. Pat. No. 4,531,178 | Uke | 7/23/85 |
| U.S. Pat. No. 4,296,459 | DeLuca | 10/20/81 |
| U.S. Pat. No. 4,161,018 | Briggs, et al | 7/10/79 |
| U.S. Pat. No. 1,487,983 | Stiriss | 3/25/24. |

More specifically, devices capable of modifying the characteristics of light through reversal of polarity of the power source have been proposed in the prior art. For example, documents U.S. Pat. No. 5,842,777 discloses a device which modifies the intensity or color of the light by reversing the polarity of the power source. Document JP 62071287 also shows a simple circuit responsive to reversal of polarity to illuminate different light sources.

Portable signaling devices with flashing light sources abound. These can be divided into two main categories: (1) light sources which flash in response to wearer's movements, and (2) light sources whose on-off cycles are driven by an electronic timer circuit.

Documents U.S. Pat. Nos. 5,303,485 and 4,161,018 provide for a signaling light source which flashes intermittently in response to movement. Alternatively, documents U.S. Pat. Nos. 4,812,983 and 4,613,847 provide for a signaling light source which flashes at a constant rate while document U.S. Pat. No. 4,161,018 describes a signaling light source which flashes in a random manner. Finally, document U.S. Pat. No. 4,296,459 provides a hybrid version which is essentially a user selectable combination of both the above.

The prior art has also proposed devices intended to be worn. For example, document U.S. Pat. No. 4,613,847 describes one embodiment in which a signaling light source may be clipped onto a belt. Document U.S. Pat. No. 4,812,953 illustrates a signaling light source which is worn as an arm band while both documents U.S. Pat. Nos. 4,296,459 and 4,161,018 describe light sources to be worn as jewelry. Finally, document U.S. Pat. No. 5,303,485 discloses footwear with flashing light sources.

Moreover, three prior art references disclose portable lights with a light source turned on and off by rotating the head of the light relative to the body. Documents U.S. Pat. Nos. 4,581,686 and 4,531,178 disclose devices equipped with this type of mechanism. Both of these devices operate by interconnecting two concentrically and proximately mounted pieces by means of a thread and rotating the two pieces to bring two surfaces into contact, thereby closing an electric circuit. Furthermore, document U.S. Pat. No. 1,487,983 discloses a system which, although it does not use what is conventionally referred to as a thread to bring the surfaces into contact, does complete the circuit within the battery compartment. However, the grooved surface of the head and raised nipple of the case of document U.S. Pat. No. 1,487,983 work in a fashion which is similar to a thread.

Furthermore, document U.S. Pat. No. 4,531,178 discloses a switch structure suitable for use under water. Both documents U.S. Pat. Nos. 4,531,178 and 5,842,777 disclose a rubber O-ring to seal the cavity formed by screwing the head onto the case.

SUMMARY OF THE INVENTION

More specifically, in accordance with the present invention, there is provided a multi-mode light emitting device, comprising:

- a light module comprising a light source, a first terminal, a second terminal, and a polarity responsive controller interposed between the light source and the first and second terminals;
- a DC power source having a positive terminal and a negative terminal; and
- a switch means selectively defining either interconnections between (a) the first and positive terminals and (b) the second and negative terminals, or interconnections between (a) the first and negative terminals and (b) the second and positive terminals;

wherein the polarity responsive controller comprises:

- a steady state power supply circuit activated by the interconnections between (a) the first and positive terminals and (b) the second and negative terminals, and supplying, when activated, steady state power from the DC power source to the light source which then produces a steady state light; and
- an intermittent power supply circuit activated by the interconnections between (a) the first and negative terminals and (b) the second and positive terminals, and supplying, when activated, intermittent power from the DC power source to the light source which then produces a flashing light.

According to another aspect of the present invention, there is provided a rotatable switch mechanism, comprising:

- a hollow casing made of electrically non-conductive material, the hollow casing having a closed bottom and an opening opposite to the closed bottom to define a compartment for a battery pack having first and second terminals;
- an electrically conducting contact plate mounted on the closed bottom of the hollow casing for contact with the first terminal of the battery pack;
- a hollow cap made of electrically non-conductive material, the hollow cap being threadedly mounted on the open end of the hollow casing and having a tubular wall portion with a distal annular edge, the tubular wall portion of the hollow cap extending inside the hollow casing from the open end to the closed bottom;
- an electric load mounted inside the hollow cap, and including a contact for contact with the second terminal of the battery pack;
- an electric conductor running from the electric load along the tubular wall portion to reach and cover a portion of the distal annular edge;
- whereby rotation of the hollow cap about the hollow casing in a first direction will bring the electric conductor covering the distal annular edge into contact with the contact plate and the first terminal of the battery pack to thereby energize the electric load, and whereby rotation of the hollow cap about the hollow casing in a second direction opposite to the first direction will spread apart the electric conductor and the contact plate to de-energize the electric load.

The above defined structure therefore provides for a solution to the problem of replacing waterproof switches and reed switches commonly used in underwater applications.

According to yet another aspect of the present invention, there is provided a light-emitting device, comprising:

a hollow casing made of electrically non-conductive material, the hollow casing having a closed bottom and an opening opposite to the closed bottom to define a compartment for a battery pack having first and second terminals;

an electrically conducting contact plate mounted on the closed bottom of the hollow casing for contact with the first terminal of the battery pack;

a hollow translucent lens cap made of electrically non-conductive material, the hollow lens cap being threadedly mounted on the open end of the hollow casing and having a tubular wall portion with a distal annular edge, the tubular wall portion of the hollow lens cap extending inside the hollow casing from the open end to the closed bottom;

a light source mounted within the lens cap and comprising a first contact for contact with the second terminal of the battery pack and a second contact including an electric conductor running from the light source along the tubular wall portion to reach and cover a portion of the distal annular edge;

whereby rotation of the hollow lens cap about the hollow casing in a first direction will bring the electric conductor covering the distal annular edge into contact with the contact plate and the first terminal of the battery pack to thereby energize the light source, and whereby rotation of the hollow cap about the hollow casing in a second direction opposite to the first direction will spread apart the electric conductor and the contact plate to de-energize the light source.

According to a final aspect of the present invention, there is provided a multi-mode switch mechanism, comprising:

a load module;

a DC power source for the load module;

a polarity reversing means changeable between a first mode in which connections of a first polarity are established with the DC power source and a second mode in which connections of a second polarity opposite to the first polarity are established with the DC power source;

a user activated switch having an on position and an off position;

a water activated switch;

wherein the polarity reversing means, user activated switch and water activated switch define between the DC power source and the load module a switching arrangement in which:

when the polarity reversing means is in the first mode, current from the DC power source is supplied to the load module through the user activated switch in the on position; and when the polarity reversing means is in the second mode, current from the DC power source is supplied to the load module through the water activated switch coming into contact with water.

The foregoing and other objects, advantages and features of the present invention will become more apparent upon reading of the following non-restrictive description of a preferred embodiment thereof, given by way of example only with reference to the accompanying drawings.

DETAILED DESCRIPTION OF THE PREFERRED EMBODIMENT

A preferred embodiment of a multi-mode light-emitting device for under water applications according to the present invention will now be described.

Figure 1:
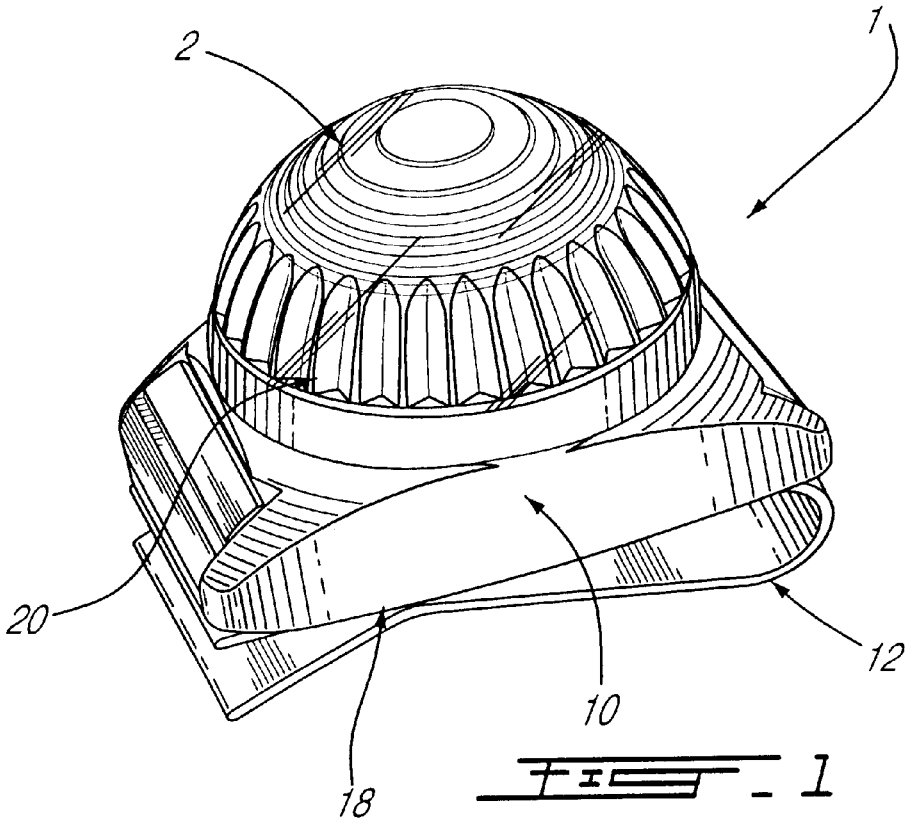
FIG. 1 is a perspective view of a preferred embodiment of multi-mode light-emitting device for underwater applications in accordance with the present invention.
Figure 3:
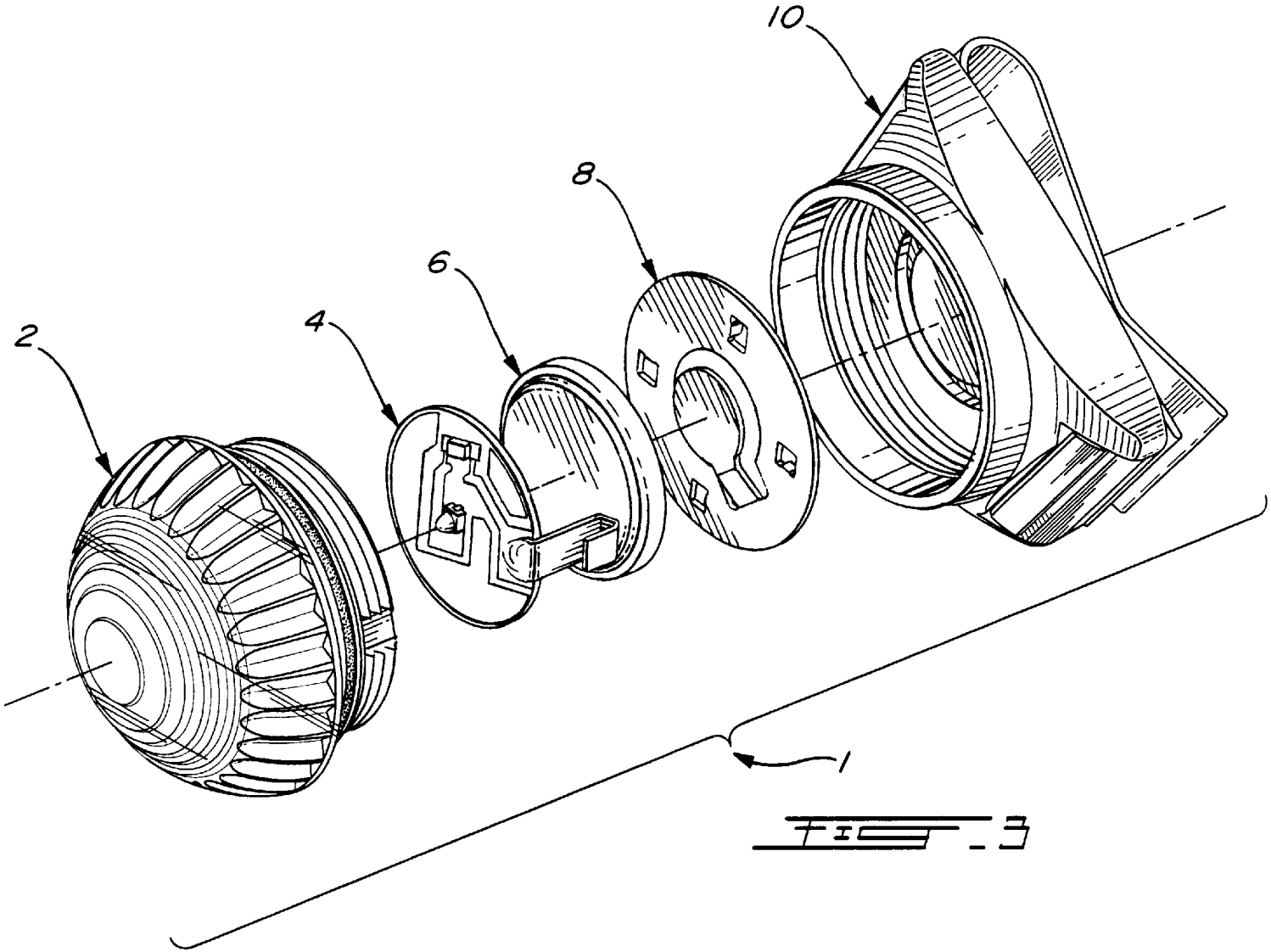
FIG. 3 is an exploded, perspective view of the multi-mode light-emitting device of FIG. 1.

Referring to FIGS. 1 and 3 of the appended drawings, this preferred embodiment of a multi-mode light-emitting device 1 includes an electrically non conductive hollow hollow cap such as a hollow lens cap 2, an electric load module such as a light module 4, a battery pack such as a coin cell battery 6, an electrically conducting contact plate 8, an electrically non conductive hollow casing 10, and an optional belt clip 12.

Figure 4:
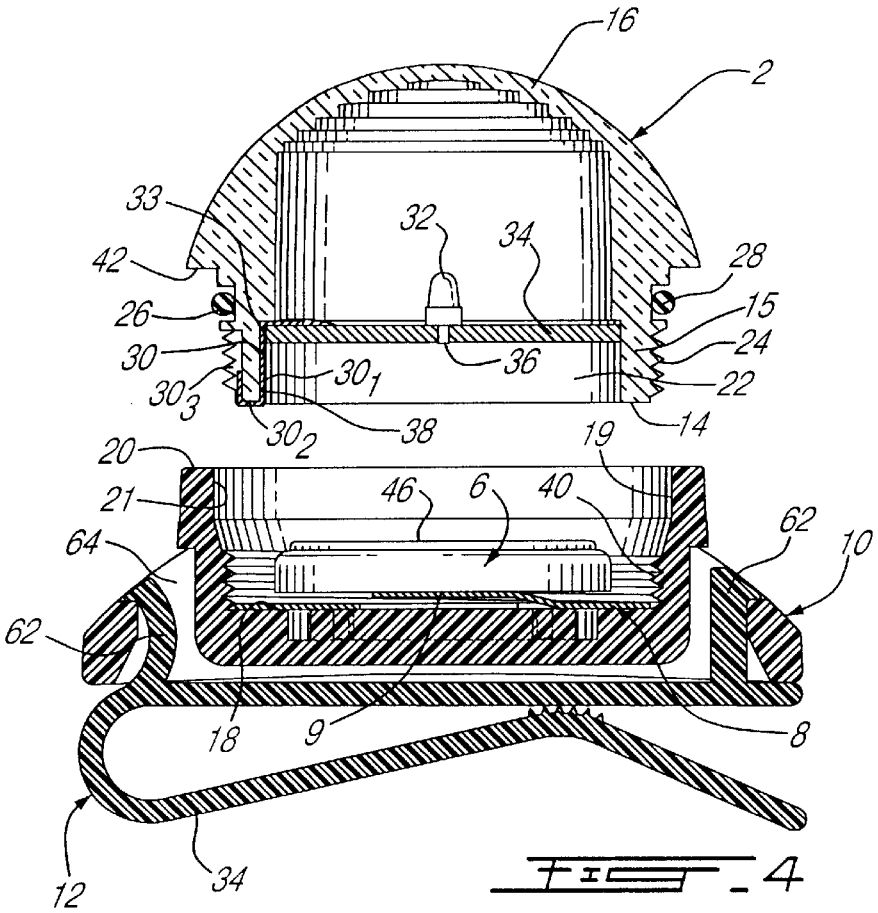
FIG. 4 is a cross sectional, elevation view of the multi-mode light-emitting device of FIG. 1.

Referring to FIG. 4, the hollow cap 4 is preferably made of molded, translucent and electrically non conductive plastic material. The hollow cap 4 defines a closed dome 16 forming a lens, an externally threaded cylindrical wall portion (tubular wall portion) 15 with a distal annular edge 14 opposite to the dome 16, and an annular shoulder 42 between the dome 16 and cylindrical wall portion 15.

An external, annular groove 26 is formed in the cylindrical portion 15 adjacent to the annular shoulder 42. This annular groove 26 seats a resilient, sealing O-ring 28.

Finally, the lens cap 2 is formed with a channel 30 having successive axial channel section $\mathbf{30}_1$ on the inner face of the cylindrical portion 15, transversal channel section $\mathbf{30}_2$ on the annular edge 14 and axial channel section $\mathbf{30}_3$ on the outer face of the cylindrical portion 15.

Again, the hollow casing 10 is made of molded, electrically non conductive plastic material, and comprises a closed, generally flat bottom 18 and an opening 20 opposite to the closed bottom 18. As illustrated in FIG. 4, the hollow casing 10 defines, between the closed bottom 18 and the opening 20, an inner cylindrical surface 19. Cylindrical surface 19 comprises a non threaded surface portion 21 adjacent to the opening 20 and a threaded surface portion 40 between surface portion 21 and the closed bottom 18.

Referring to FIGS. 1 and 4, the electrically conducting contact plate 8 is circular and snugly fits on the generally flat, closed bottom 18 of the hollow casing 10. A central spring member 9 is cut into the plate 8 to provide for appropriate electric contact with one terminal of the coin cell battery.

Figure 6:
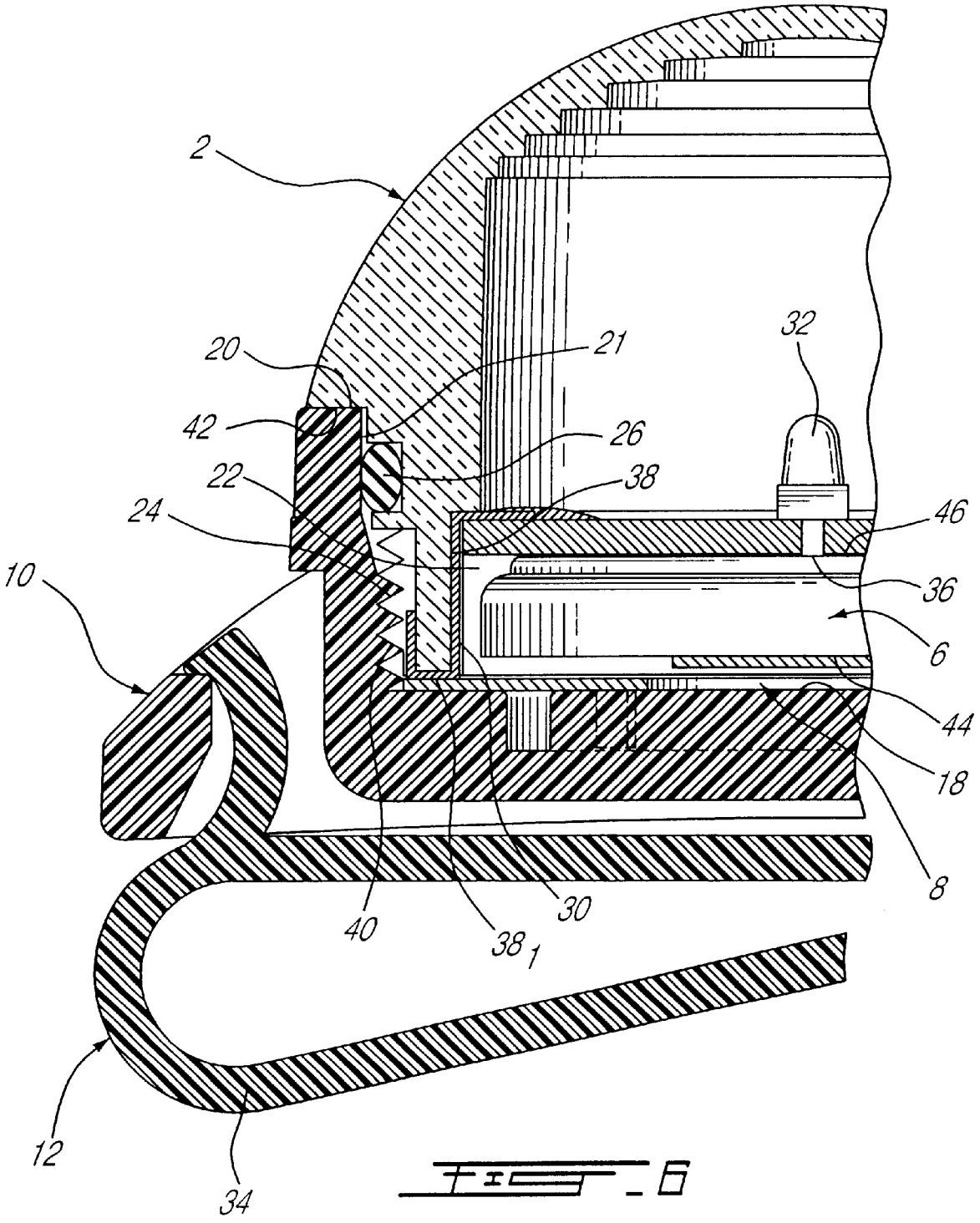
FIG. 6 is a fragmentary, cross sectional elevation view of the multi-mode light-emitting device of FIG. 1, showing an electrically conducting flat conductor in contact with an electrically conducting contact plate.

Referring now to FIG. 6, when the externally threaded cylindrical portion 15 is screwed onto the inner surface portion 40, the hollow cap 2 and casing 10 define a cavity 22.

Referring again to FIG. 4, the light module 4 comprises a light source 32 mounted centrally on one side of a circular printed circuit board 34. The light source is preferably a high intensity light-emitting diode (LED). The light module 4 is mounted in the hollow cap 2 with the circular printed circuit board 34 applied on an internal, annular shoulder 33 and with the light source 32 located within the dome 16.

Referring to FIGS. 4 and 6, the light module 4 further comprises two contact members (terminals) for connection to the coin cell battery 6 in order to supply the LED 32. The first contact member can be a metallic contact pin 36 extending through the board 34 and protruding on the side of the board 34 opposite to the LED 32. The second contact member can be a flat electric conductor 38 running from the printed circuit board through the successive channel portions $\mathbf{30}_1$, $\mathbf{30}_2$ and $\mathbf{30}_3$. A section $\mathbf{38}_1$ of the flat electric conductor 38 therefore covers the edge 14 of the hollow cap.

Figure 5:
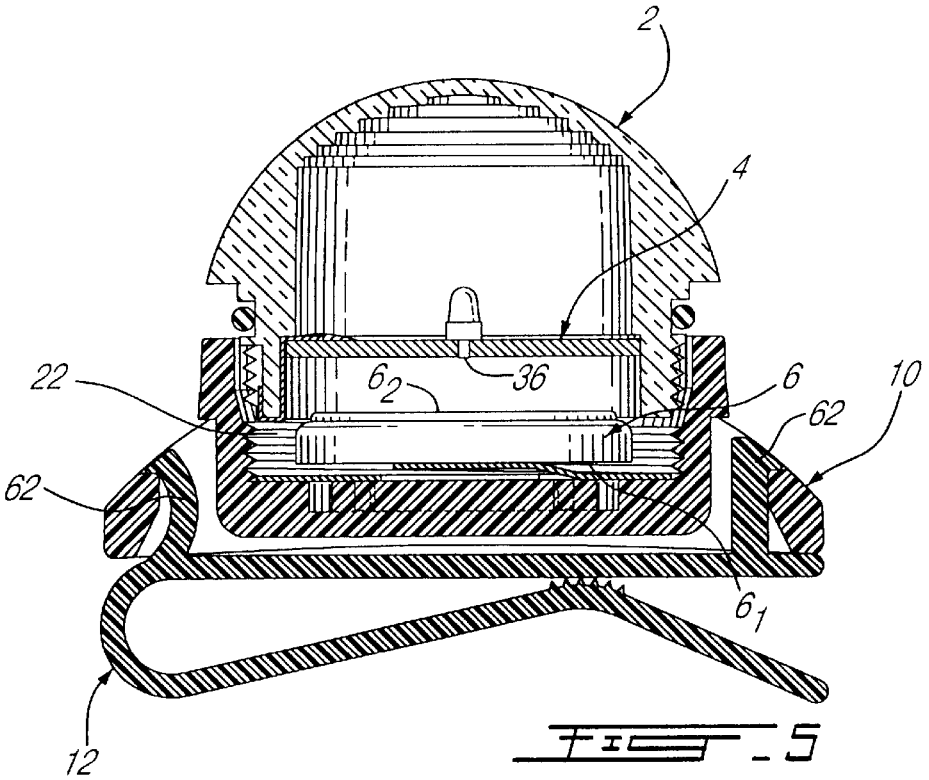
FIG. 5 is a cross sectional, elevation view of the multi-mode light-emitting device of FIG. 1.

Referring to FIGS. 5 and 6 of the appended drawings, the externally threaded cylindrical cap portion 15 is screwed onto the threaded cylindrical surface portion 40 with the coin cell battery placed in the disk like compartment 22 defined between the printed circuit board 34 and the closed bottom 18. To switch the light-emitting device on, the hollow cap 2 is rotated to screw the cylindrical cap portion 15 on the surface portion 40 until (a) a first terminal $\mathbf{6}_1$ of the coin cell battery 6 contacts the metallic contact pin 36 and (b) the section $\mathbf{38}_1$ of the flat electric conductor 38 contacts the plate 8 to contact through this plate 8 a second terminal $\mathbf{6}_2$ of the coin cell battery. This turns the LED 32 on.

Then, the resilient, sealing O-ring 28 is compressed between (a) the external, annular groove 26 formed in the cylindrical portion 15 adjacent to the annular shoulder 42, and (b) the non threaded surface portion 21 of the cylindrical surface 19 adjacent to the opening 20, to thereby seal the cavity 22 and prevent water from penetrating this cavity 22 during under water applications.

To switch the light-emitting device off, the hollow cap 2 is rotated to unscrew the cylindrical cap portion 15 from the surface portion 40 until at least the section $\mathbf{38}_1$ of the flat electric conductor 38 no longer contacts the plate 8. This turns the LED 32 off.

As it will readily appear to those of ordinary skill in the art, complete unscrewing of the cylindrical cap portion 15 from the surface portion 40 separates the hollow cap 2 and casing 10 to access the coin cell battery 6. The coin cell battery 6 can then be reversed and the hollow cap 2 and casing 10 joined together.

Let's now assume that terminal $\mathbf{6}_1$ is a positive terminal of the coin cell battery 6, and terminal $\mathbf{6}_2$ is a negative terminal of the coin cell battery 6.

Figure 8:
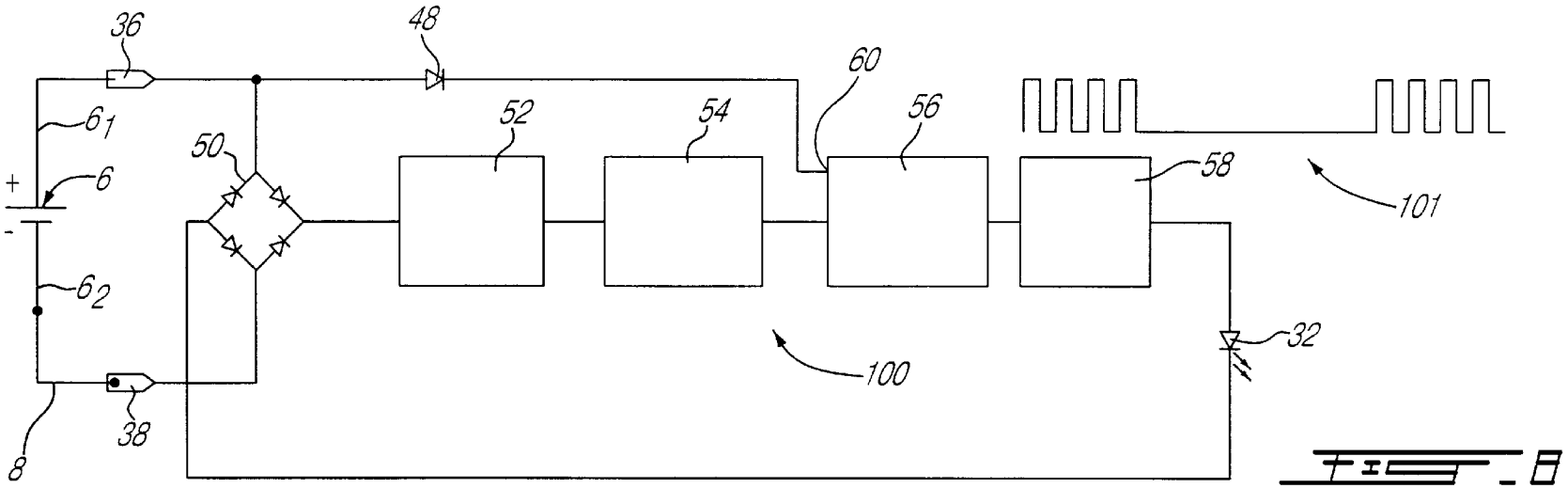
FIG. 8 is a schematic block diagram of a polarity responsive controller forming part of the multi-mode light-emitting device of FIG. 1 and operating in a flashing mode.
Figure 9:
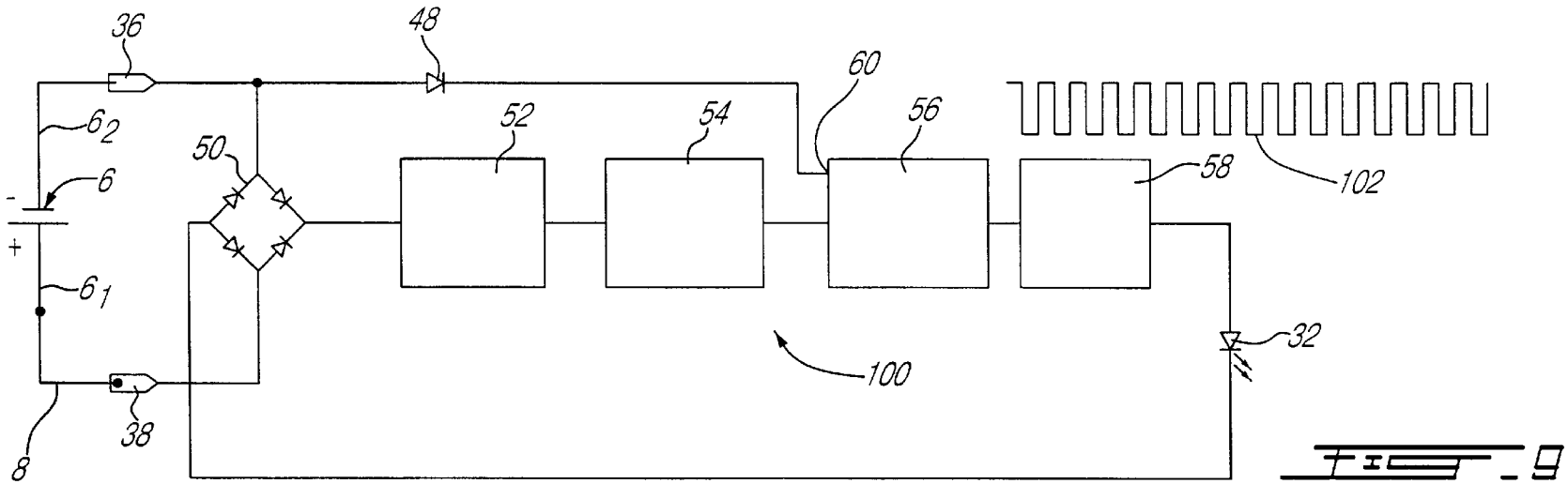
FIG. 9 is a schematic block diagram of a polarity responsive controller forming part of the multi-mode light-emitting device and operating in a steady state mode.

The schematic block diagram of FIGS. 8 and 9 is a polarity responsive controller 100 for producing steady state or intermittent lighting of the LED 32 depending on the polarity of the coin cell battery 6.

Referring to FIG. 8, the coin cell battery 6 has been placed to connect the positive terminal $\mathbf{6}_1$ to the contact pin 36 and the negative terminal $\mathbf{6}_2$ to the contact plate 8 and electric conductor 38. The controller 100 then forms an intermittent power supply circuit comprising a diode 48, a full-wave bridge rectifier 50, a 4V DC to DC converter 52, a first oscillator 54, a second oscillator 56 and a fixed current drive 58 to drive the LED 32. The first oscillator 52 and the second oscillator 54 operate at different frequencies and supply respective square wave outputs with approximately a 50% duty cycle. In the preferred embodiment the first oscillator 52 operates at a frequency of 100 kHz and the second oscillator 56 operates at a frequency of 2 Hz.

A coin cell battery 6 having its positive terminal $\mathbf{6}_1$ connected to the contact pin 36 and its negative terminal $\mathbf{6}_2$ connected to the flat conductor 38 through the contact plate 8, forward biases the diode 48 to thereby enable the second oscillator 56 via its enabling/disabling input 60. This causes the output of the first oscillator 54 to be modulated by the second oscillator 56. More specifically, the battery 6 supplies a positive voltage to to the 4V DC to DC converter 52 through the full-wave bridge rectifier 50 to activate the first oscillator 54. The second oscillator 56, which is then activated as mentioned in the foregoing description, modulates (see 101) for example at the frequency of 2 Hz the 100 kHz square wave from the first oscillator 54. The modulated output of the second oscillator 56 is supplied to the fixed current drive 58 and used to intermittently drive the LED 32.

The schematic block diagram of FIG. 9 is the same as the schematic block diagram of FIG. 8 with the exception that the battery 6 has been reversed to connect the negative terminal $\mathbf{6}_2$ to the contact pin 36 and the positive terminal $\mathbf{6}_1$ to the electric conductor 38 through the contact plate 8 to form a steady state power supply circuit. This reverse biases the diode 48 thus disabling the second oscillator 56 via its enabling/disabling pin 60. In operation, the battery 6 supplies a positive voltage to the 4V DC to DC converter 52 through the full-wave bridge rectifier 50 to activate the first oscillator 54. Then, the output 102 of the first oscillator 54 is no longer modulated by the second oscillator 56. The unmodulated output of the second oscillator 56 is supplied to the fixed current drive 58 and used to steady state drive the LED 32.

Figure 2:
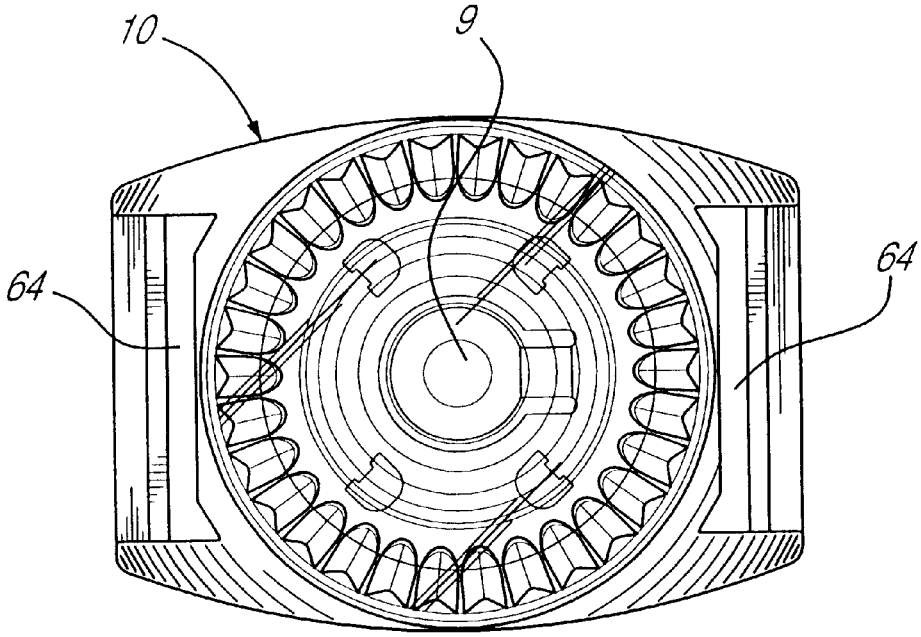
FIG. 2 is a top plan view of the multi-mode light-emitting device of FIG. 1.

Referring to FIGS. 1, 2 and 4 optionally a belt clip 12 can be mounted to the casing 10. The belt clip 12 is outfitted with two clips 62 which are inserted in corresponding accessory slots 64 integral to the hollow casing 10.

Figure 7:
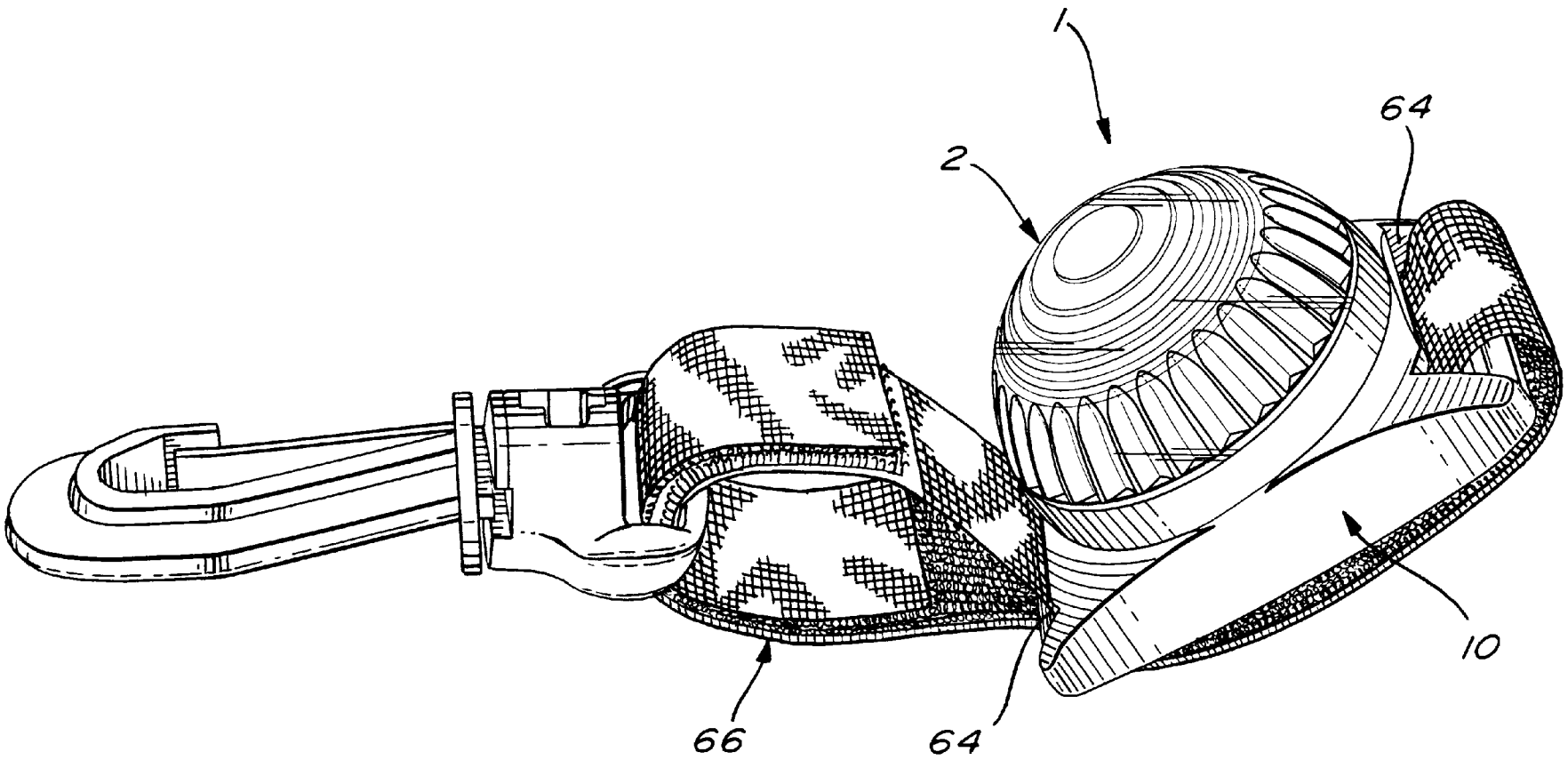
FIG. 7 is a perspective view of an alternate preferred embodiment of multi-mode light-emitting device in accordance with the present invention.

Referring to FIG. 7 and in accordance with an alternate preferred embodiment a Velcro strap 66 can be mounted to the casing 10 by inserting the strap 66 through the accessory slots 64. Also, a hook device is associated to the strap 66.

Finally, it is within the scope of the present invention to provide a multi-mode switch mechanism which can be integrated to the light-emitting device of FIGS. 1–9. This multi-mode switch mechanism comprises a load module such as the LED 32, a DC power source such as the coin cell battery 6 for the load module, and a polarity reversing means consisting of reversing the coin cell battery 6 to change between a first mode in which connections of a first polarity are established with the coin cell battery and a second mode in which connections of a second polarity opposite to the first polarity are established with the coin cell battery. A user activated switch such as described hereinabove having an on position and an off position is also provided as well as a water activated switch. The polarity reversing means, user activated switch and water activated switch define between the DC power source and the load module a switching arrangement in which:

when the polarity reversing means is in the first mode, current from the DC power source is supplied to the load module through the user activated switch in the on position; and when the polarity reversing means is in the second mode, current from the DC power source is supplied to the load module through the water activated switch coming into contact with water.

It is believed to be within the knowledge of one of ordinary skill in the art to suitably connect the polarity reversing means, the user activated switch and the water activated switch between the DC power source and the load module to define a switching arrangement suitable for the intended purpose.

Finally, just a word to mention that the light module 4 could be replaced by any other type of load, including for example a radio transmitter.

Although the present invention has been described hereinabove by way of a preferred embodiment thereof, this embodiment can be modified at will, within the scope of the appended claims, without departing from the spirit and nature of the subject invention.

What is claimed is:

1. A multi-mode light emitting device, comprising:

a light module comprising a light source, a first terminal, a second terminal, and a polarity responsive controller interposed between the light source and the first and second terminals;

a DC power source having a positive terminal and a negative terminal; and a switch means selectively defining either interconnections between (a) the first and positive terminals and (b) the second and negative terminals, or interconnections between (a) the first and negative terminals and (b) the second and positive terminals;

wherein the polarity responsive controller comprises:

a steady state power supply circuit activated by the interconnections between (a) the first and positive terminals and (b) the second and negative terminals, and supplying, when activated, steady state power from the DC power source to the light source which then produces a steady state light; and an intermittent power supply circuit activated by the interconnections between (a) the first and negative terminals and (b) the second and positive terminals, and supplying, when activated, intermittent power from the DC power source to the light source which then produces a flashing light.

2. A multi-mode light emitting device according to claim 1, wherein the DC power source is a coin cell battery.

3. A multi-mode light emitting device as defined in claim 2, wherein said switching means comprises a compartment in which said battery fits and is manually reversed to change the interconnections between the first, second, positive and negative terminals.

4. A multi-mode light-emitting device as defined in claim 1, wherein the polarity responsive controller comprises:

a first oscillator delivering an output signal at first frequency in response to DC power from the DC power source;

a second oscillator operating at a second frequency lower than said first frequency, interposed between the first oscillator and the light source, supplying, when not activated, the output signal from the first oscillator continuously to the light source to produce steady state light, and supplying, when activated, the output signal from the first oscillator intermittently at said second frequency to said light source to produce an intermittent light; and a polarity responsive enable circuit connected between the DC power source and the second oscillator, responsive to the polarity of the DC power source, activating the second oscillator in response to a first polarity of the DC power source, and deactivating the second oscillator in response to a second polarity of the DC power source opposite to the first polarity.

5. A rotatable switch mechanism, comprising:

a hollow casing made of electrically non-conductive material, said hollow casing having a closed bottom and an opening opposite to said closed bottom to define a compartment for a battery pack having first and second terminals;

an electrically conducting contact plate mounted on the closed bottom of the hollow casing for contact with the first terminal of the battery pack;

a hollow cap made of electrically non-conductive material, said hollow cap being threadedly mounted on the open end of the hollow casing and having a tubular wall portion with a distal annular edge, said tubular wall portion of the hollow cap extending inside the hollow casing from the open end to the closed bottom;

an electric load mounted inside the hollow cap, and including a contact for contact with the second terminal of the battery pack;

an electric conductor running from the electric load along the tubular wall portion to reach and cover a portion of the distal annular edge;

whereby rotation of the hollow cap about the hollow casing in a first direction will bring the electric conductor covering the distal annular edge into contact with the contact plate and the first terminal of the battery pack to thereby energize the electric load, and whereby rotation of the hollow cap about the hollow casing in a second direction opposite to the first direction will spread apart the electric conductor and the contact plate to de-energize the electric load.

6. A rotatable switch mechanism as defined in claim 5, wherein the electric load is a light source, and said hollow cap is made of a translucent electrically non conductive material.

7. A rotatable switch mechanism as defined in claim 5, further comprising a sealing means between the hollow cap and casing, said sealing means preventing water from penetrating into a cavity formed by the hollow cap and casing.

8. A rotatable switch mechanism as defined in claim 7, wherein said sealing means comprises an O-ring interposed between the hollow cap and casing.

9. A rotatable switch mechanism as defined in claim 5, wherein the hollow casing has an inner cylindrical threaded surface and the tubular wall portion is cylindrical and externally threaded for being screwed on the inner cylindrical threaded surface.

10. A rotatable switch mechanism as defined in claim 5, in which the tubular wall portion comprises a channel to receive the electric conductor.

11. A rotatable switch mechanism as defined in claim 5, wherein said hollow casing comprises a belt attachment device.

12. A rotatable switch mechanism as defined in claim 5, further comprising a printed circuit board on which the electric load is mounted, wherein the contact of the electric load comprises a metallic contact pin extending through the printed circuit board.

13. A light-emitting device, comprising:

a hollow casing made of electrically non-conductive material, said hollow casing having a closed bottom and an opening opposite to said closed bottom to define a compartment for a battery pack having first and second terminals;

an electrically conducting contact plate mounted on the closed bottom of the hollow casing for contact with the first terminal of the battery pack;

a hollow translucent lens cap made of electrically non-conductive material, said hollow lens cap being threadedly mounted on the open end of the hollow casing and having a tubular wall portion with a distal annular edge, said tubular wall portion of the hollow lens cap extending inside the hollow casing from the open end to the closed bottom;

a light source mounted within the lens cap and comprising a first contact for contact with the second terminal of the battery pack and a second contact including an electric conductor running from the light source along the tubular wall portion to reach and cover a portion of the distal annular edge;

whereby rotation of the hollow lens cap about the hollow casing in a first direction will bring the electric conductor covering the distal annular edge into contact with the contact plate and the first terminal of the battery pack to thereby energize the light source, and whereby rotation of the hollow cap about the hollow casing in a second direction opposite to the first direction will spread apart the electric conductor and the contact plate to de-energize the light source.

14. A light-emitting device as defined in claim 13, further comprising a sealing means between the hollow cap and casing, said sealing means preventing water from penetrating into a cavity formed by the hollow cap and casing.

15. A light-emitting device as defined in claim 14, wherein said sealing means comprises an O-ring interposed between the hollow cap and casing.

16. A light-emitting device as defined in claim 13, wherein the hollow casing has an inner cylindrical threaded surface and the tubular wall portion is cylindrical and externally threaded for being screwed on the inner cylindrical threaded surface.

17. A light-emitting device as defined in claim 13, in which the tubular wall portion comprises a channel to receive the electric conductor.

18. A light-emitting device as defined in claim 13, wherein said hollow casing comprises a belt attachment device.

19. A light-emitting device as defined in claim 13, further comprising a printed circuit board on which the light source is mounted, wherein the contact of the light source for contact with the second terminal of the battery pack comprises a metallic contact pin extending through the printed circuit board.

20. A multi-mode switch mechanism, comprising:

a load module;

a DC power source for said load module;

a polarity reversing means changeable between a first mode in which connections of a first polarity are established with the DC power source and a second mode in which connections of a second polarity opposite to said first polarity are established with the DC power source;

a user activated switch having an on position and an off position;

a water activated switch;

wherein said polarity reversing means, user activated switch and water activated switch define between the DC power source and the load module a switching arrangement in which:

when the polarity reversing means is in the first mode, current from the DC power source is supplied to the load module through the user activated switch in the on position; and when the polarity reversing means is in the second mode, current from the DC power source is supplied to the load module through the water activated switch coming into contact with water.

21. A multi-mode switch mechanism according to claim 20, wherein the DC power source is a coin cell battery.

22. A multi-mode switch mechanism as defined in claim 21, wherein said polarity reversing means comprises a compartment in which said battery fits and is manually reversed to change the polarity of the connections with the DC power source.

* * * * *